US012351887B2

(12) United States Patent
Zhu et al.

(10) Patent No.: US 12,351,887 B2
(45) Date of Patent: Jul. 8, 2025

(54) COLD-ROLLING STRIP STEEL WITH STRENGTH AND HARDNESS THEREOF VARYING IN THICKNESS DIRECTION AND MANUFACTURING METHOD THEREFOR

(71) Applicant: BAOSHAN IRON & STEEL CO., LTD., Shanghai (CN)

(72) Inventors: Xiaodong Zhu, Shanghai (CN); Peng Xue, Shanghai (CN); Wei Li, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 668 days.

(21) Appl. No.: 17/619,345

(22) PCT Filed: Jun. 24, 2020

(86) PCT No.: PCT/CN2020/097893
§ 371 (c)(1),
(2) Date: Dec. 15, 2021

(87) PCT Pub. No.: WO2020/259531
PCT Pub. Date: Dec. 30, 2020

(65) Prior Publication Data

US 2022/0235429 A1 Jul. 28, 2022

(30) Foreign Application Priority Data

Jun. 24, 2019 (CN) ..... 201910547182.7

(51) Int. Cl.
*C21D 9/46* (2006.01)
*C21D 1/18* (2006.01)
(Continued)

(52) U.S. Cl.
CPC ..... *C21D 9/46* (2013.01); *C21D 1/18* (2013.01); *C21D 6/002* (2013.01); *C21D 6/005* (2013.01);
(Continued)

(58) Field of Classification Search
CPC ..... C22C 38/002; C22C 38/02; C22C 38/06; C22C 38/12; C22C 38/14; C22C 38/38;
(Continued)

(56) References Cited

FOREIGN PATENT DOCUMENTS

CN 10318974 A 5/2013
CN 107513661 A * 12/2017 ..... C21D 1/18
(Continued)

OTHER PUBLICATIONS

The Extended EP Search Report dated Oct. 26, 2022.
(Continued)

*Primary Examiner* — Anthony M Liang
(74) *Attorney, Agent, or Firm* — Lei Fang, Esq.; Smith Tempel Blaha LLC

(57) ABSTRACT

Disclosed is a cold-rolled strip steel with varying strength/hardness in a thickness direction, comprising chemical elements in the following mass percentages: C 0.06-0.3 wt %, Si 0.01-2.5 wt %, Mn 0.5-3 wt %, Al 0.02-0.08 wt % and a balance of Fe and other unavoidable impurities, wherein the cold-rolled strip steel with varying strength/hardness in a thickness direction has a yield strength of ≥420 MPa, a tensile strength of ≥800 MPa, an elongation of ≥11%, and a hardness difference between two surfaces of at least 30 HV, and a method for manufacturing a cold-rolling strip steel with varying strength and hardness thereof in a thickness direction, which is characterized in that, when quenching is performed in the continuous annealing step, an asymmetric quenching and cooling process is performed on both surfaces of the strip steel.

16 Claims, 3 Drawing Sheets

(51) Int. Cl.

| | |
|---|---|
| ***C21D 6/00*** | (2006.01) |
| ***C21D 8/02*** | (2006.01) |
| ***C22C 38/00*** | (2006.01) |
| ***C22C 38/02*** | (2006.01) |
| ***C22C 38/06*** | (2006.01) |
| ***C22C 38/12*** | (2006.01) |
| ***C22C 38/14*** | (2006.01) |
| ***C22C 38/38*** | (2006.01) |

(52) U.S. Cl.
CPC ..... *C21D 6/008* (2013.01); *C21D 8/0205* (2013.01); *C21D 8/0236* (2013.01); *C22C 38/001* (2013.01); *C22C 38/002* (2013.01); *C22C 38/02* (2013.01); *C22C 38/06* (2013.01); *C22C 38/12* (2013.01); *C22C 38/14* (2013.01); *C22C 38/38* (2013.01)

(58) Field of Classification Search
CPC ..... C21D 1/18; C21D 2221/00; C21D 2221/10
See application file for complete search history.

(56) References Cited

FOREIGN PATENT DOCUMENTS

| | | | | | |
|---|---|---|---|---|---|
| CN | 109576569 | A | | 4/2019 | |
| CN | 109825764 | A | | 5/2019 | |
| EP | 2 617 850 | A1 | | 7/2013 | |
| EP | 2 749 668 | A1 | | 7/2014 | |
| JP | 2005298962 | A | | 10/2005 | |
| JP | 2010 059442 | A | | 3/2010 | |
| JP | 5453748 | B2 | | 3/2014 | |
| JP | 2015-193891 | | | 11/2015 | |
| JP | 2015193891 | A | * | 11/2015 | ..... C22C 38/002 |

OTHER PUBLICATIONS

JP Office Action dated Jan. 17, 2023 for JP App No. 2021-576725.
International Search Report for PCT/CN2020/097893 dated Sep. 29, 2020.
International Written Opinion for PCT/CN2020/097893 dated Sep. 29, 2020.

* cited by examiner

COLD-ROLLING STRIP STEEL WITH STRENGTH AND HARDNESS THEREOF VARYING IN THICKNESS DIRECTION AND MANUFACTURING METHOD THEREFOR

CROSS-REFERENCE TO RELATED APPLICATIONS

This application is a 371 U.S. National Phase of PCT International Application No. PCT/US2020/097893 filed on Jun. 24, 2020, which claims benefit and priority to Chinese patent application No. CN 201910547182.7 filed on Jun. 24, 2019, the content of both are incorporated by reference herein in their entireties.

TECHNICAL FIELD

The present disclosure relates to a strip steel and a manufacturing method thereof, in particular to a cold-rolled strip steel and a manufacturing method thereof.

BACKGROUND ART

The automotive industry requires the use of steel plates of higher strength for weight reduction and safety. The manufacture of advanced cold-rolled high-strength steel plates for automobiles generally depends on rapid cooling in a continuous annealing process. Rapid cooling is beneficial to transformation of austenite to martensite, bainite and other structures, so that high strength is obtained.

In the prior art, high-strength steel plates are mostly obtained by way of traditional uniform rapid cooling. Particularly, the temperature at which the rapid cooling of a steel plate starts is the same as the temperature at which the rapid cooling ends, and the two surfaces of the steel plate are also cooled at the same speed. The steel plate with uniform strength can be obtained in this way.

For example, Chinese Patent Publication No. CN102822375 A, published on Dec. 12, 2012, entitled "Ultra-high Strength Cold-rolled Steel Plate and Manufacturing Method Therefor", discloses an ultra-high strength cold-rolled steel plate and a manufacturing method therefor. In the technical solution disclosed in this patent document, the chemical composition is C: 0.05-0.4%, Si: 2.0% or less, Mn: 1.0-3.0%, P: 0.05% or less, S: 0.02% or less, Al: 0.01-0.05%, N: less than 0.005%. During continuous annealing, the steel involved in this document is cooled from Ac3 to a temperature in the range of the MS point-MS point +200° C. at a cooling rate of 20° C./s or higher (gas cooling), held for 0.1-60 s, and cooled to 100° C. or lower at a cooling rate of 100° C./s or higher (water cooling) to obtain a high-strength steel having a tensile strength of 1320 MPa or higher. In addition, the flatness of the steel plate is below 10 mm. However, the technical solution disclosed in this patent document employs a uniform rapid cooling process.

For another example, Chinese Patent Publication No. CN 102953002 A, published on Mar. 6, 2013, entitled "High-strength Steel Plate with Excellent Seam Weldability", discloses a high-strength steel plate with excellent seam weldability. In the technical solution disclosed in this patent document, the composition is C: 0.12-0.4%, Si: 0.003-0.5%, Mn: 0.01-1.5%, P: 0.02% or less, S: 0.01% or less, Al: 0.032-0.15%, N: 0.01% or less, Ti: 0.01-0.2%, B: 0.0001-0.001%, and the structure of the steel is a single martensitic structure. In the technical solution disclosed in the patent document, the tensile strength of the steel is 1180 MPa or higher, and a uniform rapid cooling process is also employed therein.

As can be seen from the above description, although the phase-change strengthened high-strength steel plates in the prior art have different strength grades and involve different quenching processes, they all involve a quenching process including uniform cooling. As a result, the steel plates obtained finally have uniform properties, and the strength and hardness are substantially the same in the thickness direction.

Given all this, it's desirable to provide a strip steel different from the prior art, the upper and lower surfaces of which are different in hardness which may vary gradually in a thickness direction.

SUMMARY

One object of the present disclosure is to provide a method for manufacturing a cold-rolled strip steel with varying strength/hardness in a thick direction. This manufacturing method performs an asymmetric quenching cooling process on a strip steel to achieve asymmetric distribution of the mechanical properties of the strip steel, so that gradients of hardness/strength changing gradually in the thickness direction are obtained. As a result, combined properties of high hardness, high strength, and excellent toughness, plasticity and formability are obtained at the same time.

In order to fulfill the above object, the present disclosure provides a method for manufacturing a cold-rolled strip steel with varying strength/hardness in a thick direction, comprising the following steps: smelting, continuous casting, hot rolling, cold rolling and continuous annealing, wherein when quenching is performed in the continuous annealing step, an asymmetric quenching cooling process is performed on two surfaces of the strip steel.

In the manufacturing method of the present disclosure, austenite is transformed into martensite or bainite in the quenching process, so that hardening of the steel is achieved. In a quenching process in the prior art, two surfaces of a strip steel are cooled from the same start cooling temperature to the same quenching termination temperature at the same cooling rate to finish rapid cooling (by means of this cooling technique, the cooling of the two surfaces of the strip steel is completely identical and symmetrical, and the mechanical properties of the resulting quenched steel plate are also completely symmetrical and uniform). In contrast, according to the present technical solution, an asymmetric quenching cooling technique is designed, so that the strip steel acquires mechanical properties that are asymmetric across the thickness of the strip steel. Specifically, the most important feature of the cold-rolled strip steel with varying strength/hardness in a thickness direction is the varying strength (or hardness) in the thickness direction, i.e. the upper and lower surfaces of the strip steel are different in strength (or hardness). As such, between the two surfaces of the strip steel, the strength (or hardness) varies gradually and transition from one surface of the strip steel to the other surface of the strip steel. Of the two surfaces of the strip steel with varying strength (or hardness) in a thickness direction, the surface having a relatively high hardness can be used for friction resistance and indentation resistance, while the surface having a lower hardness in the thickness direction and the transition part witness continuous decrease in strength and hardness, accompanied by continuous increase in toughness and elongation, which is conducive to improvement in formality and toughness of the strip steel.

In this regard, by taking advantage of the characteristic of a phase-change strengthened steel that it can be hardened by quenching, the present disclosure employs an asymmetric quenching cooling process for the two surfaces of the strip steel in a quenching rapid cooling step in a continuous annealing process. Therefore, the cold-rolled strip steel with varying strength/hardness in a thickness direction finally obtained by the manufacturing method according to the present disclosure may be used in demanding applications where high requirements are imposed on strength, hardness, plasticity and formability. The cold-rolled strip steel with varying strength/hardness in a thickness direction exhibits a high hardness in a single surface which in turn is resistant to friction and indentation, while the strip steel on the whole shows superior formality and toughness.

Further, in the method for manufacturing a cold-rolled strip steel with varying strength/hardness in a thickness direction according to the present disclosure, the asymmetric quenching cooling process comprises at least one of the following:

start temperatures for cooling the two surfaces of the strip steel being asymmetric;

end temperatures for cooling the two surfaces of the strip steel being asymmetric; and cooling rates of the two surfaces of the strip steel being asymmetric.

In the above technical solution, the use of asymmetric start temperatures for cooling the two surfaces of the strip steel, or asymmetric end temperatures for cooling the two surfaces of the strip steel, or asymmetric cooling rates of the two surfaces of the strip steel, or any combination of these three conditions, can result in different cooling routes on the two sides of the strip steel, so that the two sides of the finally obtained cold-rolled strip steel with varying strength/hardness in a thickness direction differ in the difference between the contents of ferrite and martensite/bainite. As a result, the two sides of the strip steel differ in the variation of the strength in a thickness direction.

It should be noted that the medium used for cooling in the present technical solution may be water mist (for example, gas-water mixed spray) or gas. When a gas medium is used for cooling, a gas containing nitrogen and optional hydrogen can be used, wherein hydrogen has a gas volume percentage of 0-75%. In some embodiments, a mixed gas of hydrogen and nitrogen is used, wherein hydrogen has a gas volume percentage of greater than 0% to less than or equal to 75%.

Further, in the method for manufacturing a cold-rolled strip steel with varying strength/hardness in a thickness direction according to the present disclosure, when the start temperatures for cooling the two surfaces of the strip steel are asymmetric, the difference between the start temperatures for cooling the two surfaces of the strip steel is 20-100° C. Generally, the start temperatures for cooling the two sides are in the range of 650-750° C.

In the above preferred technical solution, if the start temperatures for cooling differ in less than 20° C., the thickness-wise variation of the strength or hardness of the cold-rolled strip steel with varying strength/hardness in a thickness direction will be not obvious; and if the start temperatures for cooling differ in more than 100° C., the strength or hardness of one side of the strip steel may be too low, such that the overall strength or hardness will be too low. Preferably, the difference between the start temperatures for cooling the two surfaces may be controlled within the range of 20-100° C.

Further, in the method for manufacturing a cold-rolled strip steel with varying strength/hardness in a thickness direction according to the present disclosure, when the start temperatures for cooling the two surfaces of the strip steel are asymmetric, the difference between the start temperatures for cooling the two surfaces of the strip steel is 25-100° C.

Further, in the method for manufacturing a cold-rolled strip steel with varying strength/hardness in a thickness direction according to the present disclosure, when the end temperatures for cooling the two surfaces of the strip steel are asymmetric, the difference between the end temperatures for cooling the two surfaces of the strip steel is 40-200° C. Generally, the end temperatures for cooling the two surfaces are in the range of 50-400° C.

In the above preferred technical solution, if the end temperatures for cooling differ in less than 40° C., the thickness-wise variation of the strength or hardness of the cold-rolled strip steel with varying strength/hardness in a thickness direction will be not obvious; and if the end temperatures for cooling differ in more than 200° C., the strength or hardness of one side of the strip steel may be too low, such that the overall strength or hardness of the strip steel will be too low. Preferably, the difference between the end temperatures for cooling the two surfaces may be controlled within the range of 40-200° C.

Still further, in the method for manufacturing a cold-rolled strip steel with varying strength/hardness in a thickness direction according to the present disclosure, when the end temperatures for cooling the two surfaces of the strip steel are asymmetric, the difference between the end temperatures for cooling the two surfaces of the strip steel is 50-180° C.

Further, in the method for manufacturing a cold-rolled strip steel with varying strength/hardness in a thickness direction according to the present disclosure, when the cooling rates of the two surfaces of the strip steel are asymmetric, the difference between the cooling rates of the two surfaces of the strip steel is 25-200° C./s. Generally, the cooling rates of the two sides are ≥30° C./s, and the temperature may be within the range of 30-500° C.

In the above preferred technical solution, if the cooling rates differ in less than 25° C./s, the thickness-wise variation of the strength or hardness of the strip steel will be not obvious; and if the cooling rates differ in more than 200° C./s, the strength or hardness of one side of the strip steel may be too low, such that the overall strength or hardness of the strip steel will too low. Preferably, the difference between the cooling rates of the two surfaces may be controlled within the range of 25-200° C./s.

Still further, in the method for manufacturing a cold-rolled strip steel with varying strength/hardness in a thickness direction according to the present disclosure, when the cooling rates of the two surfaces of the strip steel are asymmetric, the difference between the cooling rates of the two surfaces of the strip steel is 40-200° C./s.

In the above technical solution, the cooling rate of the side having a higher start temperature for cooling may be higher than the cooling rate of the other side, or may be lower than the cooling rate of the other side. Depending on the start temperatures for cooling the two sides, the difference therebetween, the cooling rates and the difference therebetween, the end temperature for cooling the side having a higher start temperature for cooling is generally higher than the end temperature for cooling the other side, but it may also be lower than the end temperature for cooling the other side. Preferably, the cooling rate of the side having a higher start temperature for cooling is higher than the cooling rate of the other side, and its end temperature for cooling is lower than the end temperature for cooling the other side.

Accordingly, another object of the present disclosure is to provide a cold-rolled strip steel with varying strength/hardness in a thickness direction. The higher hardness side of the cold-rolled strip steel with varying strength/hardness in a thickness direction can be used for anti-friction and anti-indentation purposes. On the other hand, the strength and hardness of the part transitioning to the side having a lower thickness-wise hardness decrease continuously, but the toughness and elongation increase continuously, so that the formability and toughness of the strip steel are improved, and the overall formality and toughness of the strip steel are relatively high.

In order to fulfill the above purpose of the present disclosure, the present disclosure provides a cold-rolled strip steel with varying strength/hardness in a thickness direction manufactured according to the above manufacturing method.

Further, in the cold-rolled strip steel with varying strength/hardness in a thickness direction, the cold-rolled strip steel with varying strength/hardness in a thickness direction has a thickness of 1.0 mm or more.

The inventors have discovered by research that if the thickness of the strip steel is less than 1.0 mm, due to the heat transfer performance of the strip steel, it's difficult to produce obvious variation in the asymmetric strength in the thickness direction. Therefore, the larger the thickness of the strip steel is, the better the thickness-wise asymmetry is obtained. From this viewpoint, the thickness of the cold-rolled strip steel with varying strength/hardness in a thickness direction can be preferably set at 1.0 mm or more, so that better asymmetry of the thickness-wise hardness can be yielded more easily.

Further, in the cold-rolled strip steel with varying strength/hardness in a thickness direction, the cold-rolled strip steel with varying strength/hardness in a thickness direction has a thickness of 1.4-2.5 mm.

Further, the cold-rolled strip steel with varying strength/hardness in a thickness direction according to the present disclosure comprises chemical elements in the following mass percentages: C 0.06-0.3 wt %, Si 0.01-2.5 wt %, Mn 0.5-3 wt %, Al 0.02-0.08 wt %, and a balance of Fe and other unavoidable impurities.

In some embodiments, the present disclosure provides a cold-rolled strip steel with varying strength/hardness in a thickness direction, comprising chemical elements in the following mass percentages: C 0.06-0.3 wt %, Si 0.01-2.5 wt %, Mn 0.5-3 wt %, Al 0.02-0.08 wt % and a balance of Fe and other unavoidable impurities, wherein the cold-rolled strip steel with varying strength/hardness in a thickness direction has a yield strength of ≥420 MPa, a tensile strength of ≥800 MPa, an elongation of ≥11%, and a hardness difference between two surfaces of at least 20 HV.

Preferably, the cold-rolled strip steel with varying strength/hardness in a thickness direction further comprises at least one of Cr, Mo and B, wherein a Cr content is ≤0.2%, a Mo content is ≤0.2%, and a B content is ≤0.0035%.

In some embodiments, the B content of the cold-rolled strip steel with varying strength/hardness in a thickness direction is <0.0005 wt %, and Cr+Mn+Mo≤3.5 wt %.

In some embodiments, the B content of the cold-rolled strip steel with varying strength/hardness in a thickness direction is in the range of 0.0005-0.0035 wt %, and Cr+Mn+Mo≤2.5 wt %.

In some embodiments, the cold-rolled strip steel with varying strength/hardness in a thickness direction further comprises at least one of V, Ti, Nb and W, wherein their contents satisfy V+Ti+Nb+W≤0.2 wt %; preferably, V≤0.1%, Ti≤0.05%, Nb≤0.05%, W≤0.2%.

In some embodiments, the thickness of the cold-rolled strip steel with varying strength/hardness in a thickness direction is 1.0 mm or more, preferably in the range of 1.4-2.5 mm.

Preferably the cold-rolled strip steel with varying strength/hardness in a thickness direction according to any embodiment comprises chemical elements in the following mass percentages: C 0.09-0.2 wt %, Si 0.3-1.2 wt %, Mn 1.5-2.5 wt %, Al 0.02-0.08 wt %, and a balance of Fe and other unavoidable impurities.

Preferably, the cold-rolled strip steel with varying strength/hardness in a thickness direction according to any embodiment has a yield strength of 435-900 MPa, a tensile strength of 820-1260 MPa, an elongation of 11-20%, and a hardness difference between the two surfaces of 35-80 HV.

In the above technical solution, the inventors have considered that the cold-rolled strip steel with varying strength/hardness in a thickness direction needs to have certain hardenability. Therefore, in the cold-rolled strip steel with varying strength/hardness in a thickness direction according to the present disclosure, the mass proportion of each chemical element is designed as described above. The design principle of the chemical elements is as follows:

C: Carbon increases strength by influencing martensite hardness. If the carbon content is too low, martensite cannot be hardened, or the strength per se is low after quenching, and the contradiction of toughness and plasticity is not prominent. However, if the carbon content is too high, martensite will get harder, the toughness will be too low, and there is greater possibility for delayed cracking to occur. As such, in order to obtain better thickness-wise variation in hardness, the mass percentage of C in the cold-rolled strip steel with varying strength/hardness in a thickness direction according to the present disclosure may be controlled in the range of 0.06-0.3 wt %. In some preferred embodiments, the mass percentage of C is controlled in the range of 0.09-0.2%.

Si: Si has less influence on hardenability. As such, the mass percentage of Si in the cold-rolled strip steel with varying strength/hardness in a thickness direction according to the present disclosure may be controlled in the range of 0.01-2.5 wt %. In some preferred embodiments, the mass percentage of Si is controlled in the range of 0.3-1.2%.

Mn: Mn is the main element for improving steel hardenability. The content of Mn needs to match with the cooling capability of the selected cooling mode, so that the resulting thick-wise asymmetric strength is desirable. If the mass percentage of Mn is too low, the strip steel cannot be hardened, and the effect of variation in strength in the thickness direction cannot be obtained. However, if the mass percentage of Mn is too high, the hardenability will be too high, and the effect of variation in strength in the thickness direction cannot be obtained, either. In order to match with the cooling capability in the quenching cooling stage, and obtain an ideal effect of variation in strength in the thickness direction, the mass percentage of Mn in the cold-rolled strip steel with varying strength/hardness in a thickness direction according to the present disclosure may be controlled in the range of 0.5-3 wt %. In some preferred embodiments, the mass percentage of Mn is controlled in the range of 1.5-2.5%.

Al: Al has the function of deoxygenation, and can refine austenite grains. Therefore, in the technical solution according to the present disclosure, the mass percentage of Al is controlled in the range of 0.02-0.08 wt %.

It should be noted that in the technical solution according to the present disclosure, the other inevitable impurity elements mainly include P, S, and N. In order to impart better properties to the strip steel, it's better to control the impurity elements to be as less as possible. In a preferred embodiment, P≤0.015%, S≤0.005%, N≤0.03%.

Further, the cold-rolled strip steel with varying strength/hardness in a thickness direction according to the present disclosure also comprises at least one of Cr, Mo and B, wherein when B is <0.0005 wt %, Cr+Mn+Mo is ≤3.5 wt %; and when the B content is in the range of 0.0005-0.0035 wt %, Cr+Mn+Mo is ≤2.5 wt %. Preferably, when Cr is present, the content of Cr is not more than 0.2%, preferably not more than 0.15%; when Mo is present, the content of Mo is not more than 0.2%, preferably not more than 0.1%; when B is present, the content of B is not more than 0.0035%, for example, in the range of 0.0005-0.0035 wt % or 0.001-0.002 wt %.

The inventors have discovered by research that, in order to improve steel hardenability and match with the mass percentage of the Mn element, so as to match the final hardenability of the strip steel with the cooling capability, and avoid the situation that the strip steel cannot be hardened or the hardenability is too high, leading to insensitivity to the change of the cooling process, preferably, the addition of Cr, Mo and Mn may be controlled as follows: when B is <0.0005 wt %, Cr+Mn+Mo≤3.5 wt %; when the content of B is in the range of 0.0005-0.0035 wt %, Cr+Mn+Mo≤2.5 wt %.

Further, the cold-rolled strip steel with varying strength/hardness in a thickness direction according to the present disclosure also comprises at least one of V, Ti, Nb and W, wherein their contents satisfy V+Ti+Nb+W≤0.2 wt %. Preferably, when V is present, the content of V is not more than 0.1%, preferably not more than 0.05%; when Ti is present, the content of Ti is not more than 0.05%, preferably not more than 0.03%; when Nb is present, the content of Nb is not more than 0.05%, preferably 0.01-0.03%; when W is present, the content of W is not more than 0.2%, preferably not more than 0.1%; and preferably, V+Ti+Nb+W≤0.2 wt %.

As can be seen from the above illumination, compared with the prior art, the cold-rolled strip steel with varying strength/hardness in a thickness direction according to the present disclosure and the method for manufacturing the same have the following advantages and beneficial effects:

In the manufacturing method according to the present disclosure, a thickness-wise asymmetric cooling technique is used to obtain a phase-change strengthened steel having an asymmetric distribution of strength (hardness) of the strip steel, so that the strip steel has high strength and hardness at one side, and good plasticity and toughness at the other side. In addition, because the properties of the two surfaces of the strip steel are different, the hardness or strength of the strip steel in the thickness direction varies gradually, so that the resulting cold-rolled strip steel with varying strength/hardness in the thickness direction is suitable for applications requiring high hardness and good friction and indentation resistance at a single side as well as good overall toughness.

In a preferred embodiment, the cold-rolled strip steel with varying strength/hardness in a thickness direction according to the present disclosure has a yield strength of ≥420 MPa, a tensile strength of ≥800 MPa, an elongation of ≥11%, a hardness of ≥220 HV at one side, and a hardness of ≥200 HV at the other side. More specifically, in some preferred embodiments, the cold-rolled strip steel with varying strength/hardness in a thickness direction according to the present disclosure has a yield strength of 435-900 MPa, a tensile strength of 820-1260 MPa, an elongation of 11-20%, a hardness of 235-380 HV at one side, and a hardness of 200-330 HV at the other side. Preferably, the hardness difference between the two sides of the cold-rolled strip steel with varying strength/hardness in a thickness direction according to the present disclosure is at least 30 HV, preferably at least 35 HV. In a preferred embodiment, the hardness difference between the two sides of the cold-rolled strip steel with varying strength/hardness in a thickness direction according to the present disclosure is in the range of 35-80 HV, so that good actual utility and a balance of strength, plasticity and toughness can be obtained.

DETAILED DESCRIPTION

Figure 1:
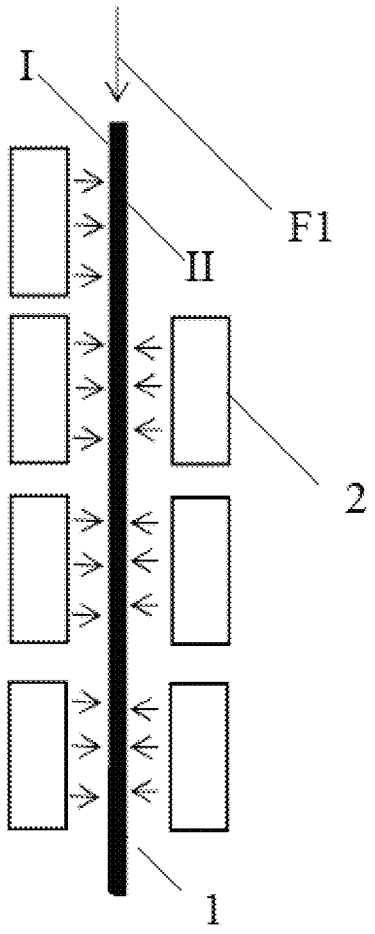
FIG. 1 schematically shows a cooling process in some embodiments of the cold-rolled strip steel with varying strength/hardness in a thickness direction according to the present disclosure.

The cold-rolled strip steel with varying strength/hardness in a thickness direction according to the disclosure and the method for manufacturing the same will be further explained and illustrated with reference to the accompanying drawings and the specific examples. Nonetheless, the explanation and illustration are not intended to unduly limit the technical solution of the disclosure.

Examples 1-6

The cold-rolled strip steel with varying strength/hardness in a thickness direction in Examples 1-6 was prepared according to the following steps:

(1) Subjecting the chemical compositions shown in Table 1 to smelting and casting;

(2) Continuous casting;

(3) Hot rolling: the temperature for heating the slab was 1170-1230° C.; the final rolling temperature was 850-910° C.; the coiling temperature was 570-630° C.; then acid washing was carried out to remove the oxide skin;

(4) Continuous annealing: firstly, the strip steel was heated to a holding temperature and held for 40-120 s; then, the strip steel was cooled at a cooling rate of 2-10° C./s; subsequently, an asymmetric quenching cooling process was carried out; tempering was performed after the quenching cooling process was finished; after tempering, the strip steel was cooled to room temperature with water; the strip steel was dried and then flattened.

In some other embodiments, after the hot rolling, the strip steel may also be cold rolled with the cold rolling reduction being controlled at 30-65%, and then the above continuous annealing in the step (4) may be carried out.

Table 1 lists the mass percentages of the various chemical elements in the cold-rolled strip steel with varying strength/hardness in a thickness direction in Examples 1-6.

TABLE 1

(wt %, the balance is Fe and other unavoidable impurities except for P, S and N)

| No. | C | Si | Mn | P | S | Al | N | Amounts of Cr, Mo, B, Nb, Ti, V |
|---|---|---|---|---|---|---|---|---|
| Ex. 1 | 0.09 | 0.45 | 2.3 | 0.012 | 0.002 | 0.05 | 0.025 | Nb: 0.03 |
| Ex. 2 | 0.09 | 0.45 | 2.3 | 0.012 | 0.002 | 0.08 | 0.025 | Ti: 0.02<br>Nb: 0.015<br>B: 0.001 |
| Ex. 3 | 0.16 | 1 | 2 | 0.01 | 0.0008 | 0.025 | 0.002 | Cr: 0.15<br>V: 0.05 |
| Ex. 4 | 0.16 | 1 | 2 | 0.01 | 0.0008 | 0.025 | 0.002 | Mo: 0.1<br>W: 0.1 |
| Ex. 5 | 0.17 | 0.4 | 1.6 | 0.01 | 0.0003 | 0.03 | 0.0018 | Mo: 0.1<br>B: 0.0015<br>Ti: 0.02 |
| Ex. 6 | 0.17 | 0.4 | 1.6 | 0.01 | 0.0003 | 0.02 | 0.0018 | Ti: 0.02<br>Nb: 0.015 |

Table 2 lists the specific process parameters used in the continuous annealing step for the cold-rolled strip steel with varying strength/hardness in a thickness direction in Examples 1-6.

TABLE 2

| No. | Holding temperature (° C.) | Start cooling temperature for side I (° C.) | Cooling rate for side I (° C./s) | Start cooling temperature for side II (° C.) | Cooling rate for side II (° C./s) | End cooling temperature for side I (° C.) | End cooling temperature for side II (° C.) | Cooling medium | Tempering temperature (° C.) | Tempering time (s) | Flattening elongation (%) |
|---|---|---|---|---|---|---|---|---|---|---|---|
| Ex. 1 | 800 | 670 | 70 | 630 | 70 | 270 | 350 | 60% $H_2$ | 270 | 200 | 0.1 |
| Ex. 2 | 800 | 670 | 70 | 670 | 70 | 270 | 330 | 60% $H_2$ | 270 | 200 | 0.1 |
| Ex. 3 | 800 | 670 | 70 | 670 | 30 | 270 | 350 | 60% $H_2$ | 270 | 300 | 0.2 |
| Ex. 4 | 800 | 670 | 70 | 630 | 30 | 270 | 300 | 60% $H_2$ | 270 | 300 | 0.2 |
| Ex. 5 | 800 | 700 | 500 | 700 | 400 | 50 | 50 | Water mist | 200 | 400 | 0.3 |
| Ex. 6 | 800 | 700 | 500 | 650 | 300 | 50 | 50 | Water mist | 200 | 400 | 0.3 |
| Ex. 7 | 800 | 670 | 30 | 600 | 70 | 320 | 250 | 60%$H_2$ | 300 | 240 | 0.2 |
| Ex. 8 | 800 | 670 | 70 | 650 | 70 | 270 | 270 | 60%$H_2$ | 270 | 200 | 0.1 |
| Comp. Ex. 1 | 800 | 670 | 70 | 670 | 70 | 270 | 270 | 60% $H_2$ | 270 | 200 | 0.1 |
| Comp. Ex. 2 | 800 | 670 | 70 | 670 | 70 | 270 | 270 | 60% $H_2$ | 270 | 300 | 0.2 |
| Comp. Ex. 3 | 800 | 700 | 500 | 700 | 500 | 50 | 50 | Water mist | 200 | 400 | 0.3 |

It should be noted that the same mass percentages of the chemical elements as shown for Example 1 were used in Comparative Example 1 for smelting; the same mass percentages of the chemical elements as shown for Example 3 were used in Comparative Example 2 for smelting; and the same mass percentages of the chemical elements as shown for Example 5 were used in Comparative Example 3 for smelting. The same mass percentages of the chemical elements as shown for Example 1 in Table 1 were used in Example 7 for smelting. The same mass percentages of the chemical elements as shown for Example 2 in Table 1 were used in Example 8 for smelting.

In addition, in order to distinguish the two surfaces of the strip steel in the thickness direction, one of the surfaces was referred to as side I, and the other surface opposite to side I was referred to as side II.

Table 3 lists the measured results of the properties of the cold-rolled strip steel with varying strength/hardness in a thickness direction in Examples 1-8 according to the present disclosure.

TABLE 3

| No. | Thickness (mm) | Yield strength (MPa) | Tensile strength $\sigma_b$ (MPa) | Elongation (%) | Hardness of side I (HV) | Hardness of the middle part (HV) | Hardness of side II (HV) |
|---|---|---|---|---|---|---|---|
| Ex. 1 | 1 | 440 | 820 | 20 | 240 | 215 | 200 |
| Ex. 2 | 1.4 | 435 | 827 | 19 | 240 | 220 | 205 |
| Ex. 3 | 1.8 | 630 | 1020 | 15 | 320 | 295 | 260 |
| Ex. 4 | 2.0 | 550 | 1000 | 16 | 320 | 288 | 240 |
| Ex. 5 | 2.2 | 900 | 1260 | 11 | 380 | 350 | 330 |
| Ex. 6 | 2.3 | 860 | 1220 | 11 | 380 | 345 | 310 |
| Ex. 7 | 2.5 | 850 | 1225 | 12 | 375 | 340 | 315 |
| Ex. 8 | 1 | 445 | 826 | 20 | 238 | 218 | 203 |
| Comp. Ex. 1 | 1.6 | 500 | 850 | 15 | 247 | 250 | 246 |
| Comp. Ex. 2 | 1.6 | 680 | 1060 | 13 | 330 | 337 | 335 |
| Comp. Ex. 3 | 1.6 | 940 | 1290 | 9 | 395 | 390 | 385 |

Note:

By preparing a metallographic sample, the hardness of the two sides and the middle part is measured in the thickness direction with a microhardness tester.

As can be seen from Tables 2 and 3, the prior art technique is adopted for the strip steel of Comparative Examples 1-3, so the cooling on both sides of the strip steel is completely identical and symmetric, and the mechanical properties of the quenched steel plate obtained are also completely symmetric and uniform. In contrast, an asymmetric quenching cooling process is adopted for the cold-rolled strip steel with varying strength/hardness in a thick direction according to Examples 1-8 in the present disclosure, so an asymmetric distribution of the mechanical properties of the strip steel is achieved. As a result, gradients of hardness/strength changing gradually in the thickness direction are obtained. Thus, combined properties of high hardness, high strength, and excellent toughness, ductility and formability are obtained at the same time.

Figure 2:
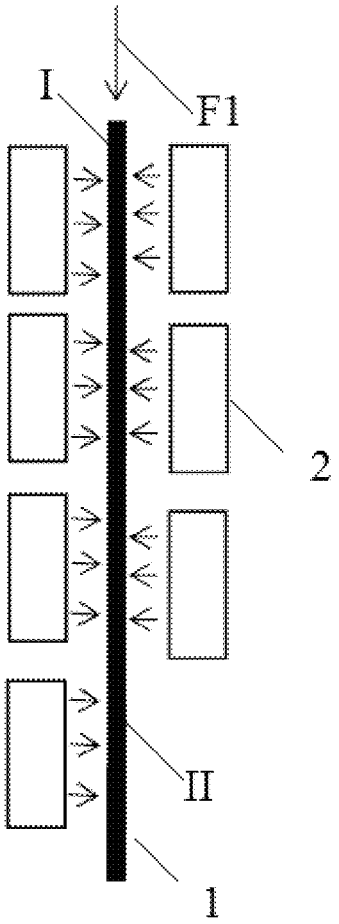
FIG. 2 schematically shows a cooling process in some other embodiments of the cold-rolled strip steel with varying strength/hardness in a thickness direction according to the present disclosure.
Figure 3:
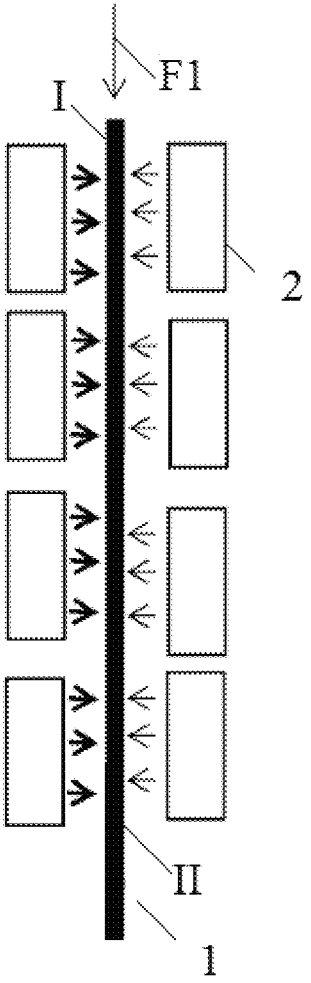
FIG. 3 schematically shows a cooling process in still some other embodiments of the cold-rolled strip steel with varying strength/hardness in a thickness direction according to the present disclosure.

FIGS. 1 to 3 schematically show different asymmetric quenching cooling processes used for different Examples.

FIG. 1 schematically shows a cooling process in some embodiments of the cold-rolled strip steel with varying strength/hardness in a thickness direction according to the present disclosure.

As shown by FIG. 1, after the cold-rolled steel strip 1 enters the continuous annealing stage along the forward direction F1, the two sides of the strip steel are cooled from different start temperatures. Side I is cooled by the spray from the nozzle of the cooling module 2 before side II is cooled by the spray from the cooling nozzle. Therefore, different cooling routes can be developed on the two sides of the strip steel. For the rapid cooling at different surfaces, the start temperatures are different, and the cooling lengths are different, so that the end temperatures of the rapid cooling are also different. As a result, the contents of ferrite and martensite/bainite are different in different surfaces. Ultimately, the strength of the strip steel varies in the thickness direction.

With the use of the asymmetric cooling process shown by FIG. 1, side I of the strip steel has a higher hardness, a lower ferrite content, a higher martensite content, and a lower bainite content. In contrast, side II has a lower hardness, a lower ferrite content, a lower martensite content, and a higher bainite content.

FIG. 2 schematically shows a cooling process in some other embodiments of the cold-rolled strip steel with varying strength/hardness in a thickness direction according to the present disclosure.

As shown by FIG. 2, after the cold-rolled strip steel 1 enters the continuous annealing stage along the forward direction F1, the two sides of the strip steel are cooled from the same start temperature, but the end temperatures are different. When the operation of the cooling nozzle of the cooling module 2 corresponding to side II of the strip steel stops, the cooling nozzle corresponding to side I continues working to cool side I to a lower temperature. Therefore, different cooling routes are developed on the two sides of the strip steel. As a result, the end temperatures for cooling sides I and II of the strip steel are different, which in turn leads to different contents of ferrite and martensite/bainite. Ultimately, the strength of the strip steel varies in the thickness direction.

With the use of this asymmetric cooling process, side I of the strip steel has a higher hardness and a higher martensite content, while side II has a lower hardness, a lower martensite content and a higher bainite content.

FIG. 3 schematically shows a cooling process in still some other embodiments of the cold-rolled strip steel with varying strength/hardness in a thickness direction according to the present disclosure.

As shown by FIG. 3, after the cold-rolled strip steel 1 enters the continuous annealing stage along the forward direction F1, the two sides of the strip steel are cooled from the same start temperature, and the end time is also the same. However, due to the different cooling abilities of the cooling nozzles of the cooling modules 2 positioned on the two sides of the strip steel, the nozzle corresponding to side I provides a faster cooling rate, while the nozzle corresponding to side II provides a relatively lower cooling rate. Therefore, different cooling routes are developed on the two sides of the strip steel. Put another way, different cooling rates are resulted, thereby leading to different contents of ferrite and martensite/bainite, and eventually variation in the strength of the strip steel in the thickness direction.

With the use of this asymmetric cooling process, side I of the strip steel has a higher hardness and a higher martensite content, while side II has a lower hardness, a higher ferrite content, a lower martensite content and a higher bainite content.

It should be noted that the difference in cooling rate can be resulted from different cooling media sprayed through the nozzles, or adjustment of the spraying speed or flow rate of the cooling medium, so that the cooling rates on sides I and II are different. For example, a medium with a higher heat exchange ability, or a higher spray speed, or a higher flow rate may be used for side I, so as to achieve a faster cooling rate.

In addition, in some other embodiments, the cooling processes illustrated in FIG. 1, FIG. 2 or FIG. 3 described above may also be combined to realize an asymmetric quenching cooling process.

In summary, it can be seen that, by utilizing a thickness-wise asymmetric cooling technique, the manufacturing method according to the present disclosure provides a phase-change strengthened strip steel with a thickness-wise asymmetric strength (hardness) distribution, so that it has the advantages of high strength and hardness on one side, and good plasticity and toughness on the other side. The hardness varies gradually along the thickness direction. Hence, the resulting cold-rolled strip steel with varying strength/hardness in the thickness direction is very suitable for applications requiring high hardness and good friction and indentation resistance at a single side as well as good overall toughness.

It's to be noted that the prior art portions in the protection scope of the present disclosure are not limited to the examples set forth in the present application file. All the prior art contents not contradictory to the technical solution of the present disclosure, including but not limited to prior patent literature, prior publications, prior public uses and the like, may all be incorporated into the protection scope of the present disclosure.

In addition, the ways in which the various technical features of the present disclosure are combined are not limited to the ways recited in the claims of the present disclosure or the ways described in the specific examples. All the technical features recited in the present disclosure may be combined or integrated freely in any manner, unless contradictions are resulted.

It should also be noted that the Examples set forth above are only specific examples according to the present disclosure. Obviously, the present disclosure is not limited to the above Examples. Similar variations or modifications made thereto can be directly derived or easily contemplated from the present disclosure by those skilled in the art. They all fall in the protection scope of the present disclosure.

What is claimed is:

1. A cold-rolled strip steel with varying strength/hardness in a thickness direction, comprising chemical elements in the following mass percentages: C 0.06-0.3 wt %, Si 0.01-2.5 wt %, Mn 0.5-3 wt %, Al 0.02-0.08 wt % and a balance of Fe and other unavoidable impurities, wherein the cold-rolled strip steel with varying strength/hardness in a thickness direction has a yield strength of ≥420 MPa, a tensile strength of ≥800 MPa, an elongation of ≥11%, and a hardness difference between two surfaces having been subjected to cold-rolling of at least 30 HV; wherein the cold-rolled strip steel does not contain a deposition layer.

2. The cold-rolled strip steel with varying strength/hardness in a thickness direction according to claim 1, wherein the cold-rolled strip steel with varying strength/hardness in a thickness direction further comprises at least one of Cr, Mo and B, wherein a Cr content is ≤0.2%, a Mo content is ≤0.2%, and a B content is ≤0.0035%.

3. The cold-rolled strip steel with varying strength/hardness in a thickness direction according to claim 2, wherein the B content of the cold-rolled strip steel with varying strength/hardness in a thickness direction is <0.0005 wt %, and Cr+Mn+Mo≤3.5 wt %; or the B content of the cold-rolled strip steel with varying strength/hardness in a thickness direction is in the range of 0.0005-0.0035 wt %, and Cr+Mn+Mo≤2.5 wt %.

4. The cold-rolled strip steel with varying strength/hardness in a thickness direction according to claim 1, wherein the cold-rolled strip steel with varying strength/hardness in a thickness direction further comprises at least one of V, Ti, Nb and W, wherein their contents satisfy V+Ti+Nb+W≤0.2 wt %.

5. The cold-rolled strip steel with varying strength/hardness in a thickness direction according to claim 1, wherein the cold-rolled strip steel with varying strength/hardness in a thickness direction comprises chemical elements in the following mass percentages: C 0.09-0.2 wt %, Si 0.3-1.2 wt %, Mn 1.5-2.5 wt %, Al 0.02-0.08 wt %, and a balance of Fe and other unavoidable impurities.

6. The cold-rolled strip steel with varying strength/hardness in a thickness direction according to claim 1, wherein the cold-rolled strip steel with varying strength/hardness in a thickness direction has a yield strength of 435-900 MPa, a tensile strength of 820-1260 MPa, an elongation of 11-20%, and a hardness difference between the two surfaces of 35-80 HV.

7. A manufacturing method for the cold-rolled strip steel with varying strength/hardness in a thickness direction of claim 1, comprising the following steps: smelting, continuous casting, hot rolling, cold rolling and continuous annealing, wherein when quenching is performed in the continuous annealing step, an asymmetric quenching cooling process is performed on two surfaces of the strip steel.

8. The manufacturing method for a cold-rolled strip steel with varying strength/hardness in a thickness direction according to claim 7, wherein the asymmetric quenching cooling process comprises at least one of the following:

start temperatures for cooling the two surfaces of the strip steel being asymmetric;

end temperatures for cooling the two surfaces of the strip steel being asymmetric; and cooling rates of the two surfaces of the strip steel being asymmetric.

9. The manufacturing method for a cold-rolled strip steel with varying strength/hardness in a thickness direction according to claim 8, wherein when the start temperatures for cooling the two surfaces of the strip steel are asymmetric, a difference between the start temperatures for cooling the two surfaces of the strip steel is 20-100° C.

10. The manufacturing method for a cold-rolled strip steel with varying strength/hardness in a thickness direction according to claim 9, wherein when the start temperatures for cooling the two surfaces of the strip steel are asymmetric, the difference between the start temperatures for cooling the two surfaces of the strip steel is 25-100° C.

11. The manufacturing method for a cold-rolled strip steel with varying strength/hardness in a thickness direction according to claim 8, wherein when the end temperatures for cooling the two surfaces of the strip steel are asymmetric, a difference between the end temperatures for cooling the two surfaces of the strip steel is 40-200° C.

12. The manufacturing method for a cold-rolled strip steel with varying strength/hardness in a thickness direction according to claim 11, wherein when the end temperatures for cooling the two surfaces of the strip steel are asymmetric, the difference between the end temperatures for cooling the two surfaces of the strip steel is 50-180° C.

13. The manufacturing method for a cold-rolled strip steel with varying strength/hardness in a thickness direction according to claim 8, wherein when the cooling rates of the two surfaces of the strip steel are asymmetric, a difference between the cooling rates of the two surfaces of the strip steel is 25-200° C./s.

14. The manufacturing method for a cold-rolled strip steel with varying strength/hardness in a thickness direction according to claim 13, wherein when the cooling rates of the two surfaces of the strip steel are asymmetric, the difference between the cooling rates of the two surfaces of the strip steel is 40-200° C./s.

15. The cold-rolled strip steel with varying strength/hardness in a thickness direction according to claim 1, wherein the cold-rolled strip steel with varying strength/hardness in a thickness direction has a thickness of 1.0 mm or more.

16. The cold-rolled strip steel with varying strength/hardness in a thickness direction according to claim 15, wherein the cold-rolled strip steel with varying strength/hardness in a thickness direction has a thickness of 1.4-2.5 mm.

* * * * *